US005722015A

United States Patent [19]

Tombs

[11] Patent Number: 5,722,015

[45] Date of Patent: Feb. 24, 1998

[54] METHOD AND APPARATUS FOR ADJUSTING THE CHARGE ON TONER

[75] Inventor: Thomas N. Tombs, Brockport, N.Y.

[73] Assignee: Eastman Kodak Company, Rochester, N.Y.

[21] Appl. No.: 640,025

[22] Filed: Apr. 30, 1996

[51] Int. Cl.[6] ..... G03G 21/00

[52] U.S. Cl. ..... 399/129; 399/101

[58] Field of Search ..... 399/101, 129, 399/149, 150, 349, 357, 308, 302, 128, 343

[56] References Cited

U.S. PATENT DOCUMENTS

| | | | |
|---|---|---|---|
| 3,914,045 | 10/1975 | Namiki et al. . | |
| 4,252,433 | 2/1981 | Sullivan | 399/357 |
| 4,259,003 | 3/1981 | Mangal et al. | 399/129 |
| 4,727,453 | 2/1988 | Ewing | 361/225 |
| 4,862,224 | 8/1989 | Ku . | |
| 5,087,939 | 2/1992 | McDougal . | |
| 5,321,471 | 6/1994 | Ito et al. | 399/129 |
| 5,412,454 | 5/1995 | Asanae | 399/150 |
| 5,463,450 | 10/1995 | Inoue et al. . | |
| 5,469,247 | 11/1995 | Cheng et al. | 399/350 |

FOREIGN PATENT DOCUMENTS

| | | |
|---|---|---|
| 63-210981 | 9/1988 | Japan . |
| 5-224544 | 9/1993 | Japan . |
| 7-064444 | 3/1995 | Japan . |
| 8-054771 | 2/1996 | Japan . |

*Primary Examiner*—Robert Beatty
*Attorney, Agent, or Firm*—Leonard W. Treash, Jr.

[57] ABSTRACT

Residual toner on a photoconductive or intermediate image member is adjusted in charge prior to cleaning by a roller which is rolled by the image member. The roller is biased to either apply charge to the toner or reduce charge, depending upon the type of cleaning. The roller includes a compliant blanket made of polyurethane covered by a thin coat of material having a Young's Modulus greater than $1\times10^7$ Pascals.

12 Claims, 1 Drawing Sheet

METHOD AND APPARATUS FOR ADJUSTING THE CHARGE ON TONER

This invention .relates to the adjustment of charge on toner carried by a surface of an image member, for example, a photoconductive image member or an intermediate image member.

In electrophotographic or other electrostatic imaging a toner image is formed on a surface of an image member and ultimately transferred to a receiving surface, for example, a receiving sheet. The toner image may be transferred from the image member on which it is formed to an intermediate image member before transfer to its final resting surface.

In this process it is common, for various reasons, to want to adjust the charge on the toner. For example, it is common to use an erase lamp and/or a corona to adjust the charge on residual toner left on an image member after transfer of the toner image to another surface to make the residual toner easier to dean. The nature of the charge adjustment depends upon the cleaning mechanism used. If the cleaner is a nonconductive brush or other similar device which primarily physically removes the cleaner, it is preferred to treat the toner to reduce its charge as much as possible. If, on the other hand, a magnetic brush or conductive fur brush is used with a bias encouraging cleaning, or triboelectric properties encouraging cleaning, it is generally desirable to impart a specified amount of charge to the toner that optimizes removal with the cleaning station using the bias.

Typically, a wire corona charger is positioned just before the cleaning station to make the appropriate charge adjustment. Wire chargers are high impedance devices that do not satisfactorily charge or discharge particles which are quite small and isolated from other particles by the width of several particles. Wire chargers also produce significant amounts of unwanted ozone.

U.S. Pat. No. 5,463,450 to Inoue et al, is representative of a large number of patents suggesting the use of a roller charger for applying the primary charge to a photoconductive image member in an electrophotographic process. See also, U.S. Pat. No. 4,727,453 to Ewing, issued Feb. 23, 1988.

U.S. Pat. No. 4,862,224 to Ku, issued Aug. 29, 1989, is representative of a number of references and actual product in which a silicone rubber roller is used to clean toner off a surface. The roller is biased to attract the toner, and a blade contacts the roller to clean the toner off it. U.S. Pat. No. 5,087,939 to McDougal, issued Feb. 11, 1992, shows the use of an articulatable version of the same roller to clean an intermediate transfer drum.

SUMMARY OF THE INVENTION

It is an object of the invention to provide a method and apparatus for adjusting the charge on toner carded on a surface, which method and apparatus have advantages over conventional wire chargers.

This and other objects are accomplished by an image forming method and apparatus in which toner on a surface is passed through a nip between a member, such as a roller and the image member, which charge adjusting member is electrically controlled to adjust the charge on the toner.

According to a preferred embodiment, the charge is adjusted on residual toner on a surface of either a photoconductive image member or an intermediate image member immediately prior to cleaning the toner off the surface.

According to other preferred embodiments, the charge adjustment to the toner made by the roller depends upon the type of cleaning used. If the cleaning involves primarily physical removal, for example, with an insulative fur brush, an AC bias with no DC component is applied to the roller. If the cleaning is with a conductive fur brush or a magnetic brush relying on a particular polarity of charge on the toner, the roller is biased to apply that polarity of charge to the toner, with or without an AC bias.

DETAILED DESCRIPTION OF THE INVENTION

Figure 1:
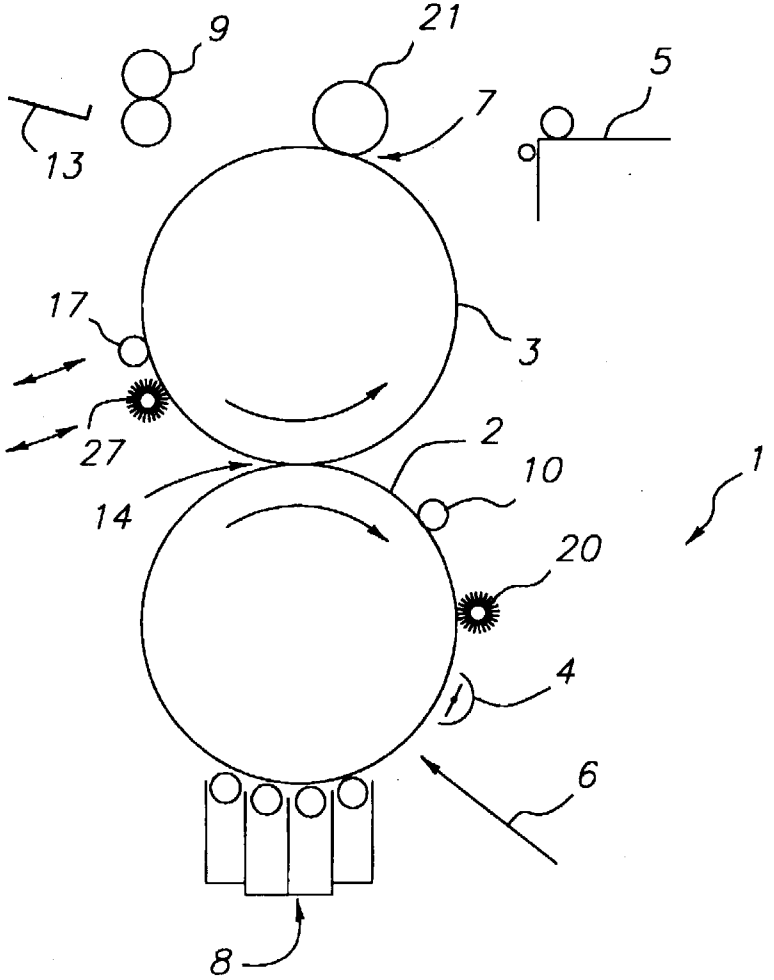
FIG. 1 is a side schematic of an image forming apparatus.

FIG. 1 shows an electrophotographic image forming apparatus 1 which includes two image members, a photoconductive image member 2 and an intermediate image member 3, both image members being well known in the art.

Toner images are formed on photoconductive image member 2 through the conventional electrophotographic process of uniformly charging a surface of photoconductive image member 2 with a corona charger 4, imagewise exposing the charged surface with a suitable exposing device, for example, laser 6, to create an electrostatic image, and toning the electrostatic image by the application of a toner from a toning device 8. Toning device 8 is shown as having four distinct toning stations, each one capable of applying a different color toner so that a series of images of different color can be formed on photoconductive image member 2. Each toner image is transferred to intermediate image member 3 at a transfer station 14. Transfer is conventionally accomplished by an electrical field created between the two image members by appropriate means, not shown.

If more than one image is formed of different color on photoconductive image member 2, those images can be transferred in registration to intermediate image member 3 to form a multicolor image. Whether a single toner image or a series of toner images are transferred to intermediate image member 3, it or they are transferred at a transfer station 7 to a receiving sheet fed from a receiving sheet supply 5. Transfer station 7 includes a backup roller 21 to assist in creating a transfer field at station 7. The receiving sheet with the toner image, whether it be a single toner or a multicolor image with multiple distinct toners, is moved to a fuser 9 where it is fixed and, hence, to an output tray 13.

Both of the image members need to be cleaned for continuous use. A cleaning device 20 is schematically shown in FIG. 1 positioned after transfer station 14 to remove residual toner from the surface of photoconductive image member 2 prior to the surface entering charger 4. Similarly, an articulatable cleaning device 27 is positioned in the path to clean the surface of intermediate image member 3 before it re-enters the nip of transfer station 14.

To improve the cleaning of both cleaning devices 20 and 27, charge adjusting rollers 10 and 17 (also articulatable) are positioned ahead of the cleaning devices 20 and 27, respectively. The rollers 10 and 17 work in combination with their respective cleaning devices 20 and 27, as can be shown better with reference to FIG. 2. According to FIG. 2, residual toner 23 remaining on a surface 50 (which surface can be of either image member 2 or 3) is contacted by roller 10 (or roller 17 in FIG. 1). Roller 10 is frictionally rolled by surface 50. An electrical bias is applied to it from a power source 25 to appropriately adjust the charge on toner 23. Roller 10 has a conductive core 11 to which the bias from voltage source 25 is applied. Conductive core 11 is covered by a thin blanket 12 of a material soft enough not to damage the surface 50, for example, a silicone rubber or a polyurethane. To assist in application of the field, it is preferred that the blanket 12 have an electrical volume resistivity less than $10^{12}$ ohm-cm, preferably between $10^5$ and $10^9$ ohm-cm. A blanket having a Young's modulus of between $10^6$ and $10^7$ Pascals provides sufficient compliance to prevent damage is to the imaging member and also provides better contact with surface 50. Optionally, a cleaning blade 30 is positioned in contact with roller 10 to clean any toner off roller 10 that is picked up from surface 50.

Figure 2:
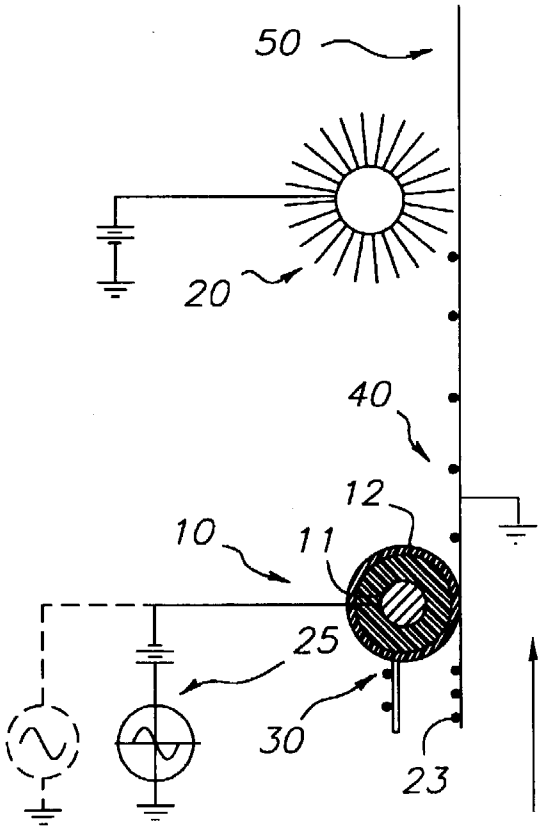
FIG. 2 is a side schematic of a portion of an image forming apparatus which includes a charge adjusting roller, a cleaning station and a portion of an image member.

Power source 25 applies a bias to conductive core 11 according to the adjustment in charge desired on toner 23. This is largely determined by the nature of cleaning station 20 (or 27). In FIG. 2 cleaning station 20 is shown as a conductive fur brush to which a bias is applied, making the brush attractive to toner 23. For example, if toner 23 has an original negative charge, it is preferred that the brush 20 be biased positively to attract that toner. Charge on toner 23 may become altered, especially from passage through either transfer station 14 or transfer station 7. For best cleaning in this embodiment, a negative charge is applied to toner 23 by roller 10. Thus, power source 25 is shown with a DC component that is negative. When surface 50 is on a photoconductive image member, such as photoconductive image member 2, this DC component preferably provides a voltage to the toner and image member between 400 and 800 volts (whether negative or positive). When surface 50 is on an intermediate image member, such as intermediate image member 3, that voltage can be somewhat higher, since breakdown of the image member is not generally a problem with an intermediate as it may be with a photoconductive image member. The bias on the roller to provide these voltages at the image member depends on the thickness and resistivity of the blanket, but could be much higher than these voltages. Best results are achieved with a constant current source. Thoroughness of charging can be improved if the bias from power source 25 also includes an AC component, as well as the DC component, as is shown in FIG. 2.

This charging mechanism, shown in FIG. 2, in which a charge is applied to toner 23 for cleaning by a biased cleaning station, is useful with any cleaning station which relies on a charged toner for effectiveness. Thus, it would not only include a conductive or semi-conductive and biased fur brush but also a typical magnetic brush cleaner which relies on a bias and, in some cases, a triboelectric attraction between the brush and charged toner.

Many cleaning brushes, most notably insulative fur brushes, physically scrub the surface and are most effective when the toner has as little charge as possible. Since much of the toner exits the transfer station in a charged state, that charge needs to be reduced. In this embodiment, an AC bias without a DC component is applied to roller 10. Using this arrangement, the charge on toner 23 can be substantially reduced, making cleaning station 20 more effective.

Blade 30 is not necessary in most applications. The roller 10 does have a tendency to pick up some toner. However, much of it is redeposited on the surface 50 with its charge properly adjusted and from where it is cleaned off by cleaning device 20. The amount of toner picked up on roller 10 reaches equilibrium at a point at which the effectiveness of the roller is not reduced.

Although this invention appears to have particular utility in adjusting the charge on toner prior to cleaning, it could also be used in other applications. For example, it is sometimes useful to adjust charge on toner prior to transfer. This is particularly true in processes in which images contain toners of opposite polarities, and one of the polarities needs to be reversed or the charge eliminated prior to effective electrostatic transfer. For use in this application, care must be taken not to disrupt the image. In such an application, an outer coating on the blanket of a material more resistant to offset than an ordinary polyurethane is useful. Preferably, that coating has a Young's modulus greater than $1\times10^7$ Pascals. The use of a cleaning blade, such as cleaning blade 30, is preferred in such an application.

The invention has been described in detail with particular reference to a preferred embodiment thereof, but it will be understood that variations and modifications can be effected within the spirit and scope of the invention as described hereinabove and as defined in the appended claims.

I claim:

1. An image forming apparatus comprising:

an image member with residual toner to be cleaned, a roller positioned to be rolled by the image member, said roller including a conductive core covered by a compliant blanket, said blanket defining a surface which contacts the toner and the surface of the image member, and wherein the blanket is made of polyurethane covered by a thin coating of a material having a Young's modulus greater than $1\times10^7$ Pascals, and means for applying a bias to the roller to adjust the charge on the toner to make the toner more readily cleaned.

2. Image forming apparatus according to claim 1 wherein the means for applying a bias includes means for applying a bias having an AC component and no DC component to remove charge from the residual toner.

3. Image forming apparatus according to claim 1 wherein the means for applying a bias includes means for applying a bias having a DC component of a first polarity to increase the amount of charge on the toner of the first polarity.

4. Image forming apparatus according to claim 3 wherein the means for applying a bias includes means for applying a bias also including an AC component.

5. Image forming apparatus according to claim 1 wherein the blanket has an electrical volume resistivity between $10^5$ and $10^7$ ohm-cm.

6. Image forming apparatus according to claim 1 wherein the blanket has a Young's modulus of between $10^6$ and $10^7$ Pascals.

7. Image forming apparatus according to claim 1 wherein the blanket is made of silicone rubber.

8. Image forming apparatus according to claim 1 wherein the image member is a photoconductive image member.

9. Image forming apparatus according to claim 1 wherein the image member is an intermediate image member, said image forming apparatus also includes a photoconductive image member from which a toner image is transferable to said intermediate image member.

10. Image forming apparatus comprising:

a first image member on which a toner image is formable, an intermediate image member positioned in transfer relation with the first image member, means for transferring a toner image from the first image member to the intermediate image member, means for transferring the toner image from the intermediate image member to a receiving surface, leaving residual toner on the intermediate image member, means for cleaning residual toner off the intermediate image member, means upstream of the means for cleaning for adjusting the charge on the residual toner on the intermediate image member so that such residual toner is more easily cleaned by the cleaning means, said adjusting means including a roller which is positioned in contact with the intermediate image member and rollable by the intermediate image member and means for applying a bias to the roller, said bias having at least AC or DC components for adjusting the charge on the residual toner.

11. Image forming apparatus according to claim 10 wherein the means for applying a bias to the roller includes means for applying a bias having a DC component of a first polarity to increase the charge of the first polarity on the toner.

12. Image forming apparatus according to claim 10 wherein the means for applying a bias includes means for applying a bias having an AC component and no DC component to reduce charge on the residual toner.

* * * * *